US007533839B2

(12) United States Patent
Wang

(10) Patent No.: US 7,533,839 B2
(45) Date of Patent: May 19, 2009

(54) CUTTING BLADE AND ROTARY CUTTING ASSEMBLY FOR SHREDDERS

(75) Inventor: Tie Chun Wang, Taipei (TW)

(73) Assignee: Michilin Prosperity Co., Ltd (TW)

( * ) Notice: Subject to any disclaimer, the term of this patent is extended or adjusted under 35 U.S.C. 154(b) by 0 days.

(21) Appl. No.: 11/602,133

(22) Filed: Nov. 20, 2006

(65) Prior Publication Data

US 2008/0115647 A1 May 22, 2008

(51) Int. Cl.
*B02C 18/16* (2006.01)

(52) U.S. Cl. ..... 241/295; 241/236

(58) Field of Classification Search ..... 241/295, 241/236

See application file for complete search history.

(56) References Cited

U.S. PATENT DOCUMENTS 2,655,213 A * 10/1953 Anderson ..... 83/356.3
4,925,116 A * 5/1990 Lundell ..... 241/236
5,048,764 A * 9/1991 Flament ..... 241/36
5,676,321 A 10/1997 Kroger
6,676,050 B2 1/2004 Chang
6,981,667 B2 1/2006 Huang
6,983,903 B2 1/2006 Chang
7,044,410 B2 5/2006 Huang
7,048,218 B2 5/2006 Huang
7,328,867 B1 2/2008 Lo
7,354,012 B2 4/2008 Huang
2005/0109867 A1 5/2005 Huang
2006/0102763 A1 5/2006 Bai
2007/0063084 A1 3/2007 New
2007/0125895 A1 6/2007 Chen
2007/0152089 A1 7/2007 Chen
2007/0181721 A1 8/2007 Ko
2007/0295845 A1 12/2007 Huang

* cited by examiner

*Primary Examiner*—Mark Rosenbaum
(74) *Attorney, Agent, or Firm*—Venable LLP; Roy A. Kim

(57) ABSTRACT

The present invention relates generally to cutting blades for shredders. Specifically, this invention teaches cutting blades and a rotary cutting assembly which reduce the power needed to shred paper, plastic, and other forms of media that hold information. This is accomplished by creating a cutting blade with at least three adjacent teeth. The formation of three or more adjacent teeth more readily tears through paper and other media thus reducing the amount of power necessary to drive a shredder.

4 Claims, 13 Drawing Sheets

CUTTING BLADE AND ROTARY CUTTING ASSEMBLY FOR SHREDDERS

BACKGROUND OF THE INVENTION

1. Field of the Invention

The present invention relates generally to cutting blades for shredders. Specifically, this invention teaches cutting blades and a rotary cutting assembly which reduce the power needed to shred paper, plastic, and other forms of media that hold information.

2. Background Information

With increased privacy concerns, shredders have become an integral part in both homes and businesses. Though originally used to destroy paper products, shredders are now used to shred other forms of media that hold information, such as compact discs. In addition, credit cards and other plastic products are commonly shredded.

Conventional shredders use a plurality of cutting blades spaced apart along a rotary shaft to form a rotary cutting assembly. Articles are shredded when fed through two parallel and opposite rotating rotary cutting assemblies.

The first common conventional shredder, called the strip-cut shredder, cut paper into strips along the entire length of the paper. A drawback with this type of shredder is that the strips can be pieced together like a puzzle.

In order to decrease this likelihood, shredder manufacturers developed the cross-cut shredder which shreds paper into tiny rectangles. This is accomplished by again having two parallel and opposite rotating rotary cutting assemblies. Cutting blades are again spaced apart along the length of each rotary shaft. When paper is fed through the two rotary cutting assemblies, it is cut in a similar fashion as the strip cut shredder. However, the cutting blades also have teeth protruding from the blade which puncture the strips into small rectangles, for example into 4 mm×40 mm pieces.

The teeth of each cutting blade are offset in the longitudinal direction of the rotary shaft such that they form a helix around the rotary shaft. The teeth are offset in order to decrease the amount of power needed to cut the paper. If the teeth were aligned in a row, then they would punch the paper at the same time, thus requiring a more powerful motor to simultaneously punch through the paper.

The Diamond Cut shredder was the next innovation in shredders. Through the use of a unique and novel rotary cutting assembly utilizing round undulating blades, Diamond Cut shredders, are able to shred paper in a diamond shape, thus offering maximum security.

Irrespective of the type of cut, shredders may be generally categorized according to the maximum number of sheets that it can shred. For example, a 10 sheet cross-cut shredder is designed to shred a maximum of 10 sheets. A 16 sheet cross-cut shredder is designed to shred a maximum of 16 sheets. Logically, the size of the shredder motor increases as the maximum number of sheets that the shredder can shred increases. More powerful motors are needed to shred greater amounts of paper, and are heavier and use more energy than the motors requiring less torque.

In order to save energy and reduce the size of the motor currently employed in shredders, the present invention seeks to employ various cutting blades and configurations which more readily shred paper thus reducing the size of the motor and saving energy.

One preferred embodiment of the claimed invention provides this by adding an additional cutting blade between the two cutting blades that are typically employed in a cross-cut shredder. The additional cutting blade has a spear shaped tooth which, in conjunction with two adjacent teeth, more readily tears through and shreds the paper. From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for a more efficient and power saving cutting blade incorporated into a rotary cutting assembly. In one preferred embodiment, an inner cutting blade having features of the present invention comprises a circular blade with at least two teeth that are spear shaped protruding from the blade. The inner cutting blade is then placed between two outer cutting blades with the same number of teeth, except the outer cutting blade teeth are flat and narrow. The blades are aligned such that the inner spear shaped tooth is sandwiched between the two outer, flat and narrow teeth. The blades are then spaced apart along the length of a rotary shaft and displaced along the longitudinal axis in order to form a helix around the rotary shaft. This novel rotary cutting assembly requires less power to shred. For instance, a 10 sheet shredder motor can now be used to shred 16 sheets.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

DETAILED DESCRIPTION OF THE INVENTION

The essential elements of a shredder are comprised of a base, a housing, and a shredder mechanism which resides in the housing. The shredder mechanism contains two rotary cutting assemblies which shred paper as the paper is fed through the assemblies.

This invention discloses a rotary cutting assembly with a configuration that more efficiently shreds paper, thus requiring less power. The rotary cutting assembly is comprised of cutting blades spaced apart along the length of a rotary shaft. The cutting blade or blades are configured such that teeth protrude from it as described below.

Figure 2:
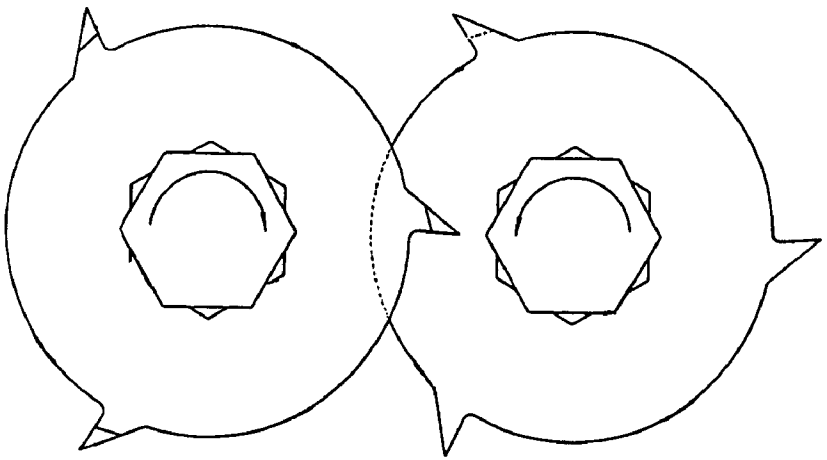
Fig. 2 Prior Art
FIG. 2 is a planar view of prior art cutting blades.
Figure 1:
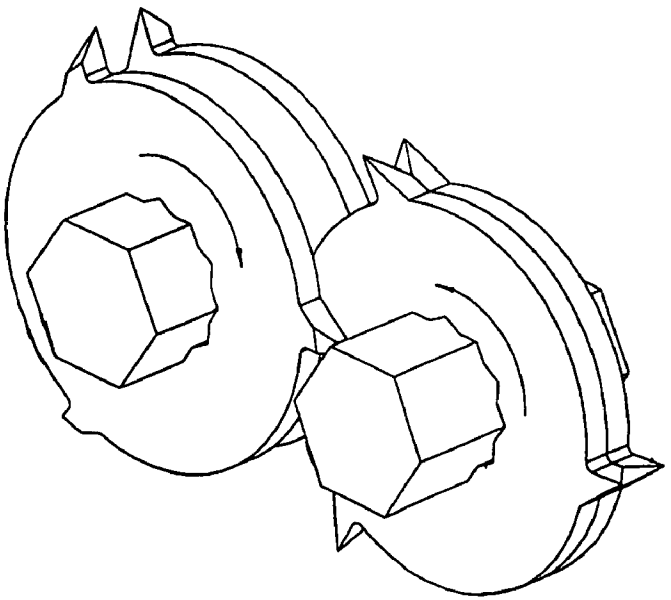
Fig. 1 Prior Art
FIG. 1 is a perspective view of prior art cutting blades.
Figures 3, 4:
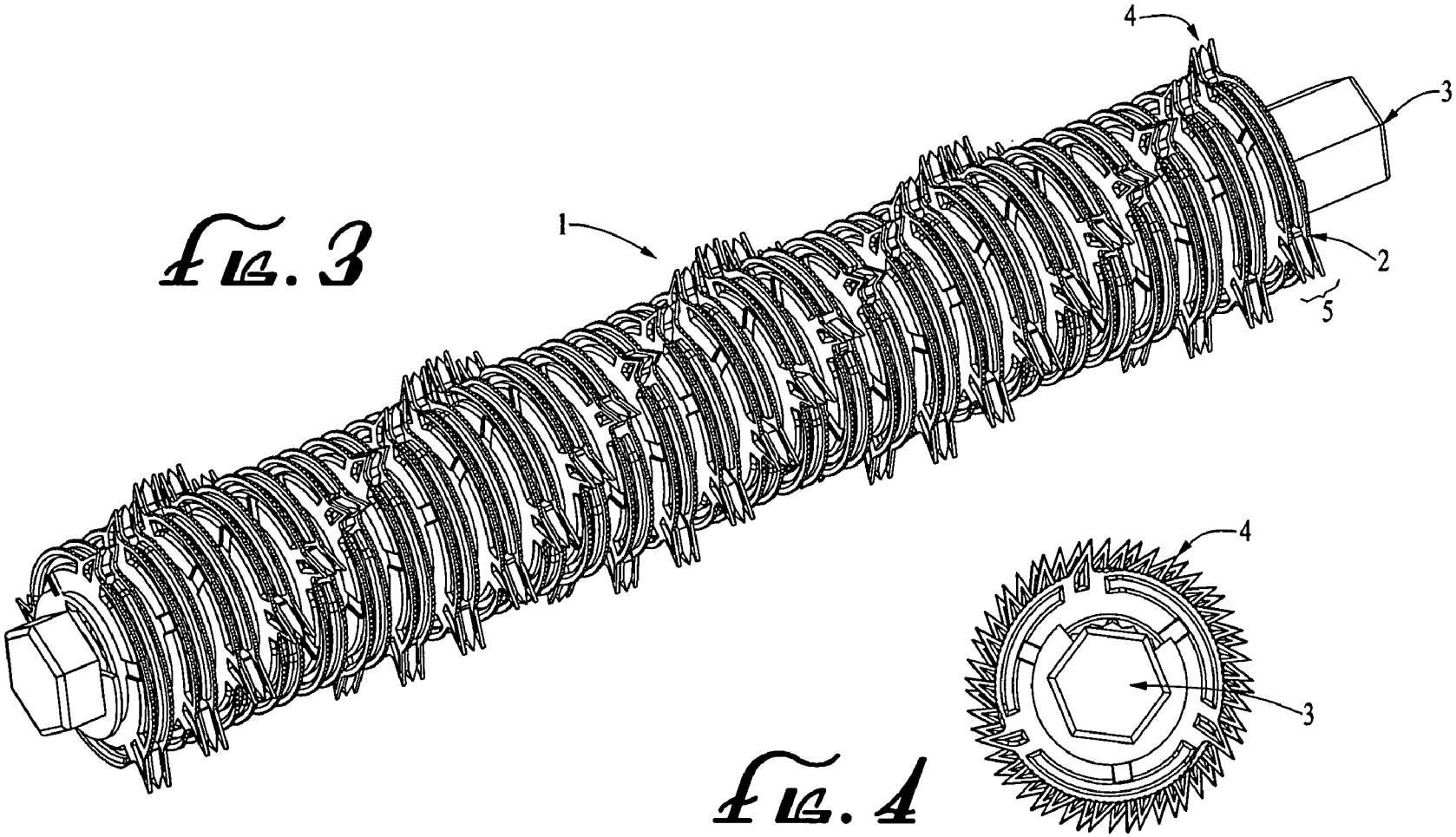
FIG. 3 is a perspective view of a rotary cutting assembly embodying features of this invention.
FIG. 4 is an elevation side view of a rotary cutting assembly.
Figure 5:
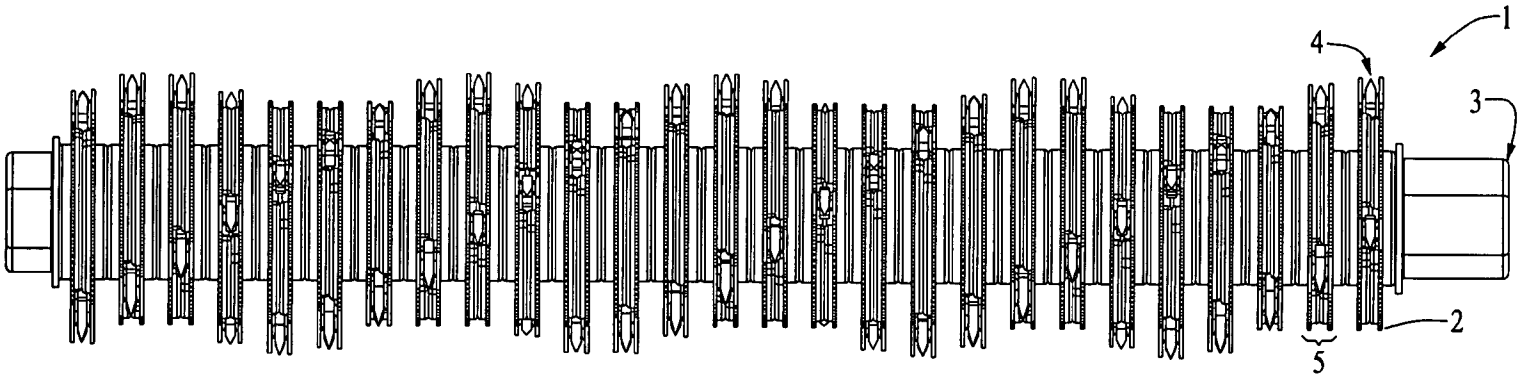
FIG. 5 is an elevation front view of a rotary cutting assembly.
Figure 6:
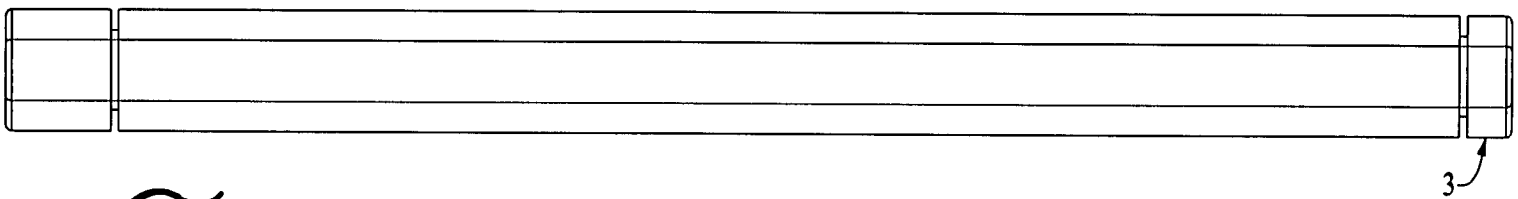
FIG. 6 is an elevation front view of the rotary shaft.
Figure 7:
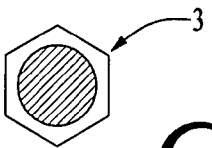
FIG. 7 is an elevation side view of the rotary shaft.

FIGS. 3-20 disclose a first preferred embodiment of a rotary cutting assembly 1 with three cutting blades 2 forming a cutting blade assembly 5. As shown in FIGS. 3 and 5, the rotary cutting assembly 1 is comprised of cutting blade assemblies 5 spaced apart along the length of the rotary shaft 3. Each cutting blade assembly 5 has a plurality of teeth 4 that protrude from the cutting blades 2. As illustrated in FIGS. 6 and 7, the rotary shaft 3 is preferably hexagon in shape and made of a durable metal alloy such as steel.

Figure 10:
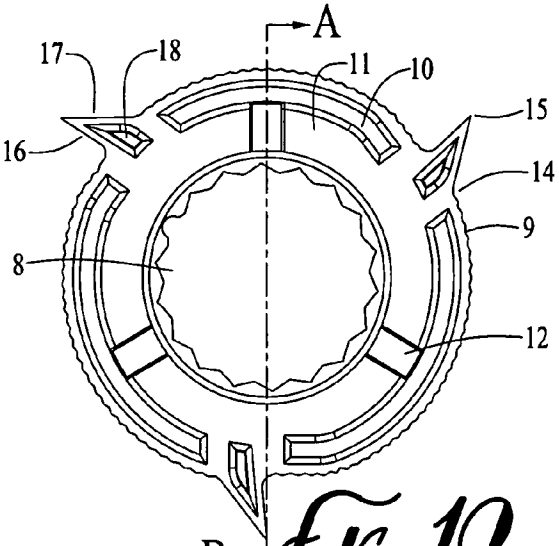
FIG. 10 is a front elevation view of a cutting blade embodying features of this invention.
Figure 9:
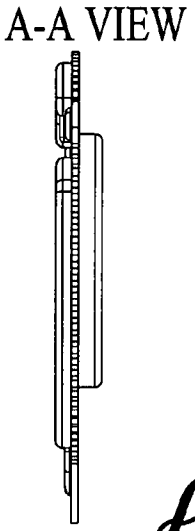
FIG. 9 is a side elevation view of a cutting blade embodying features of this invention.
Figure 8:
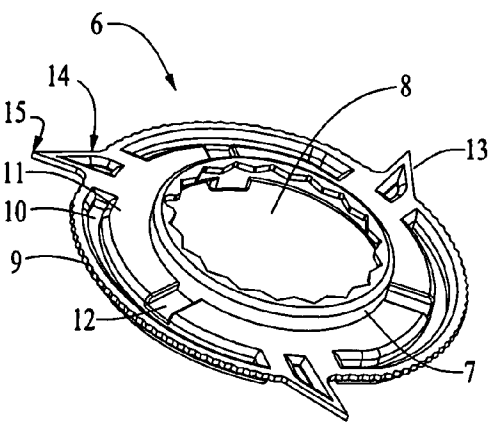
FIG. 8 is a perspective view of a blade embodying features of this invention.

In one preferred embodiment, the three cutting blades are coupled together to form a cutting blade assembly 5 (see FIG. 14) and then spaced apart along the rotary shaft from other cutting blade assemblies 5. FIGS. 8-10 illustrate the outer cutting blades 6 of the cutting blade assembly 5. The outer cutting blades 6 have a hub 7 with polygonal hole 8 formed in the center of the hub 7 through which a rotary shaft 3 may pass. The polygonal shape locks into the hexagon shaped rotary shaft thereby securing the cutting blade such that it will not rotate around the rotary shaft.

It is preferable that the periphery 9 of the outer cutting blade is serrated, though not necessary. The serration may serve to pull the paper to be cut through the rotary cutting assemblies. Towards the periphery of the outer cutting blade 6 is a plurality of indentations or ribs 10 in the body 11 of the cutting blade. The ribs 10 serve to reinforce the cutting blade and prevent it from flexing. In addition, the ribs 10 hold the inner cutting blade 19 in place. Substantially perpendicular to the ribs are additional indentations or spokes 12. The spokes 12 also serve as reinforcement for the cutting blade. In addition, the spokes 12 serve to support the inner cutting blade 19.

The outer cutting blades 6 also have three flat, narrow teeth 13 located 120 degrees apart around the circumference of the cutting blade. It should be appreciated that for larger capacity shredders which require larger cutting blades with a greater circumference, four teeth can be placed 90 degrees apart around the periphery. For shredders with smaller capacities and thus smaller cutting blades, two teeth can be placed 180 degrees apart around the periphery. The distance between the teeth determines the size of the shredded material. If there is less distance, the material is shredded into smaller pieces.

The outer cutting blade tooth 13 is preferably the same width as the cutting blade along the serrated periphery, and maintains the same width from the base 14 of the tooth to its tip 15. One side 16 of the outer cutting blade tooth is a few degrees from perpendicular to the tangent at the circumference of the cutting blade, while the other sloping side 17 is greater than 105 degrees from the tangent. The tooth is formed when the substantially perpendicular side 16 of the tooth and the sloping side 17 meet. The tooth also has an indented portion 18 which provides reinforcement in a similar manner that the ribs 10 and spokes 12 reinforce the overall structure of the blade.

The outer blade 6 is formed when sheet metal of a thickness of about 0.6 mm is punched by a die into the form of the outer cutting blade comprised of a polygonal hole, hub, ribs, spokes, serrated periphery, and teeth.

Figure 13:
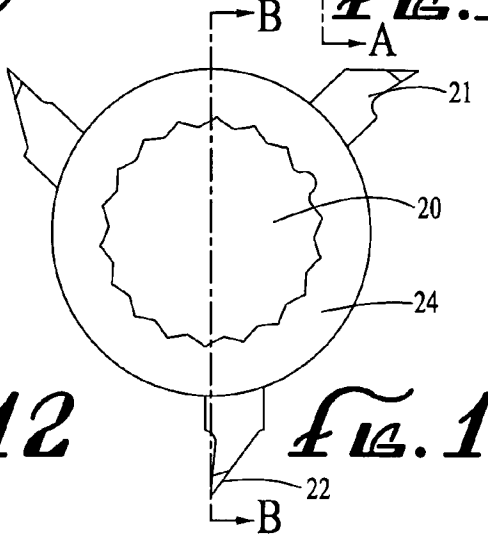
FIG. 13 is a front elevation view of a cutting blade embodying features of this invention.
Figure 12:
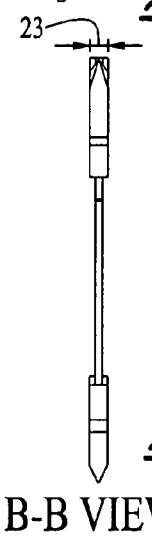
FIG. 12 is a side elevation view of a cutting blade embodying features of this invention.
Figure 11:
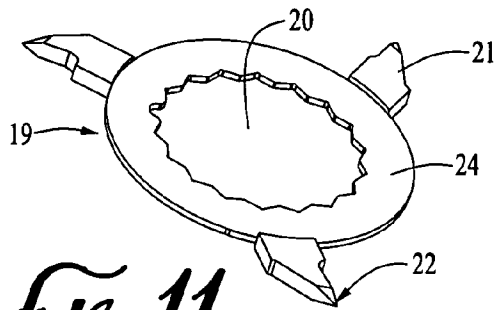
FIG. 11 is a perspective view of a cutting blade embodying features of this invention.

FIGS. 11-13 disclose the inner cutting blade 19. Like the outer cutting blade 6, the inner cutting blade 19 has a polygonal hole 20 formed in the center of it through which a rotary shaft may pass. The polygonal shape locks into the hexagon shaped rotary shaft thereby securing the cutting blade such that it will not rotate around the rotary shaft.

The inner cutting blade 19 has the same number of teeth around the periphery as the outer cutting blade. In this preferred embodiment, three teeth are located 120 degrees apart around the circumference of the inner cutting blade. As mentioned above, for larger capacity shredders which require larger cutting blades with a greater circumference, four teeth can be placed 90 degrees apart around the periphery. For shredders with smaller capacities and thus smaller cutting blades, two teeth can be placed 180 degrees apart around the periphery.

The inner cutting blade tooth 21 is preferably shaped like a spear at its tip 22. It is formed by folding over the 0.6 mm metal sheet two times such that the approximate thickness of the tooth is 1.8 mm and then punched by a die into the form of the spear shaped tooth. The width of the inner cutting tooth 23 is therefore approximately three times greater than the width of the base 24 of the inner cutting blade 19.

Figure 14:
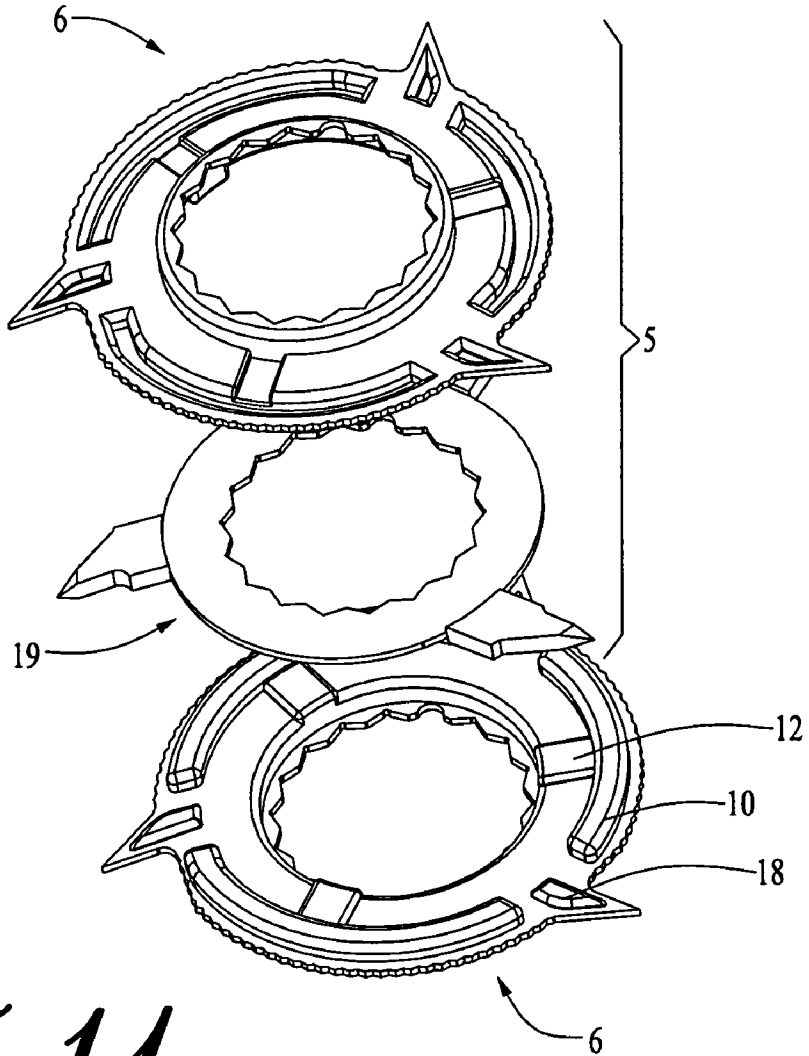
FIG. 14 is a perspective view of three cutting blades embodying features of this invention.
Figure 15:
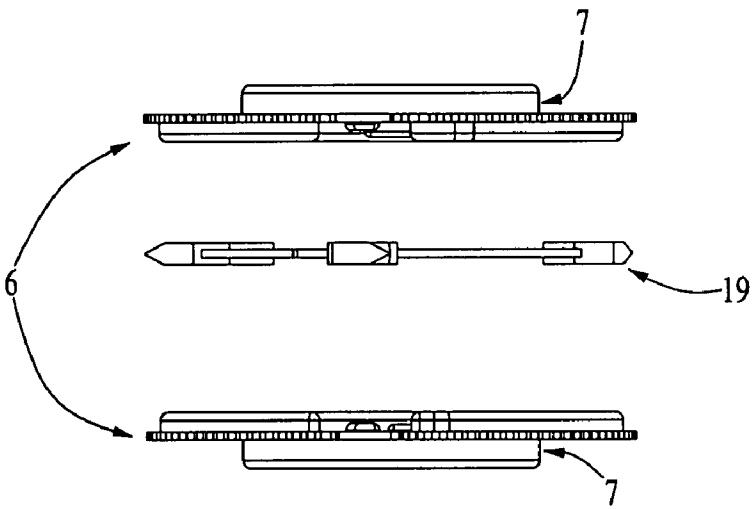
FIG. 15 is a side elevation view of a three cutting blades embodying features of this invention.

As seen in FIGS. 14 and 15, the outer cutting blades 6 sandwich and flank the inner cutting blade 19 in a configuration such that the teeth are aligned. The ribs 10 and spokes 12 of the outer cutting blade 6 and the tooth indented portion 18 provide support and secure the inner cutting blade 19 to ensure proper alignment.

It should be appreciated that although this preferred embodiment discloses three blades coupled together to form a cutting blade assembly 5, the same mechanism can be accomplished with less than three blades. For example, rather than have three blades, one blade can have a base of sufficient width to support two narrow teeth flanking a larger spear shaped tooth. In addition, in certain situations, more than three adjacent teeth may be advantageous. In such situations, one or more blades may be used to support the adjacent teeth.

Accordingly, this patent discloses a rotary cutting assembly comprised of a plurality of cutting blades; said cutting blades having at least two sets of at least three adjacent teeth wherein said adjacent teeth flank each other; said sets of adjacent teeth spaced apart from other sets of adjacent teeth along the circumference of the cutting blade. The adjacent teeth may be comprised of at least one inner tooth flanked by at least two outer teeth, wherein said outer teeth may be narrower than said inner tooth.

The patent also illustrates a rotary cutting assembly comprised of a plurality of cutting blade assemblies having at least two sets of at least three adjacent teeth, wherein said adjacent teeth flank each other, said sets of adjacent teeth being spaced apart along the circumference of the cutting blade assembly. The adjacent teeth may be comprised of at least one inner tooth flanked by at least two outer teeth, wherein said outer teeth may be narrower than said inner tooth. The cutting blade assemblies may be comprised of at least two cutting blades flanking each other.

The patent further discloses a rotary cutting assembly comprised of at least one cutting blade having at least two sets of at least three adjacent teeth wherein said adjacent teeth flank each other; said sets of adjacent teeth being spaced apart along the circumference of the cutting blade. The adjacent teeth may be comprised of at least one inner tooth flanked by at least two outer teeth, wherein said outer teeth may be narrower than said inner tooth.

Figure 16:
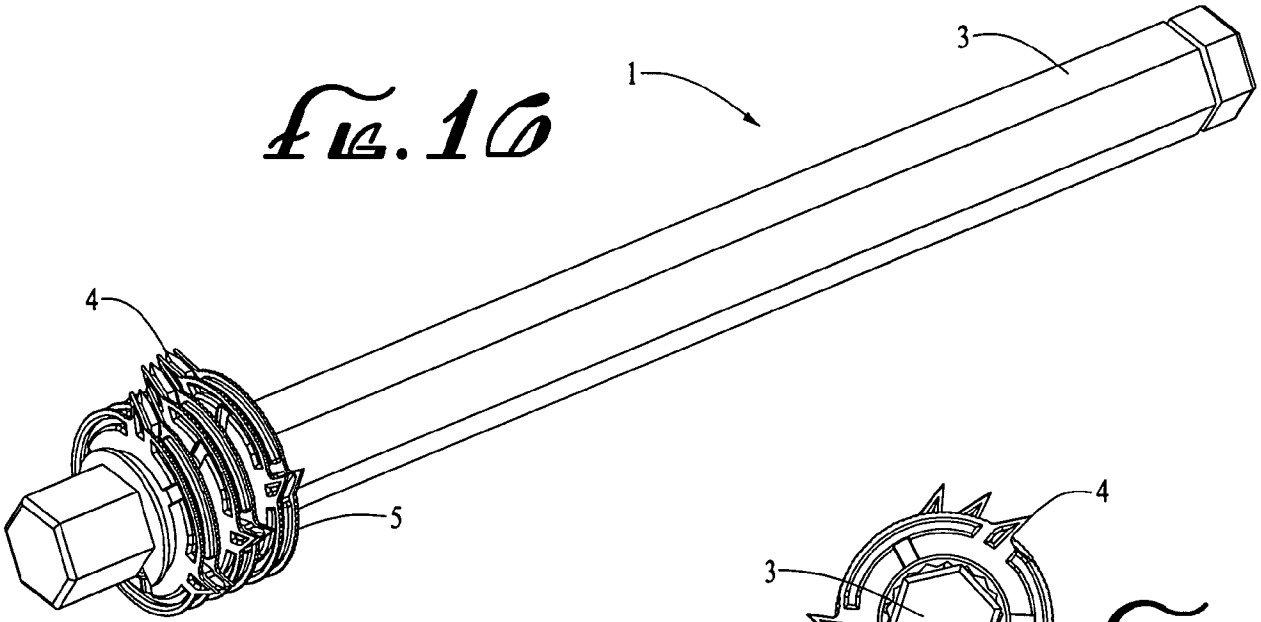
FIG. 16 is a perspective view of a partially assembled rotary cutting assembly.
Figure 18:
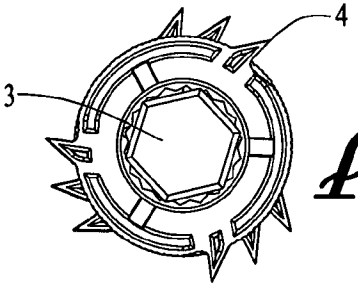
FIG. 18 is a side elevation view of a partially assembled rotary cutting assembly.
Figure 17:
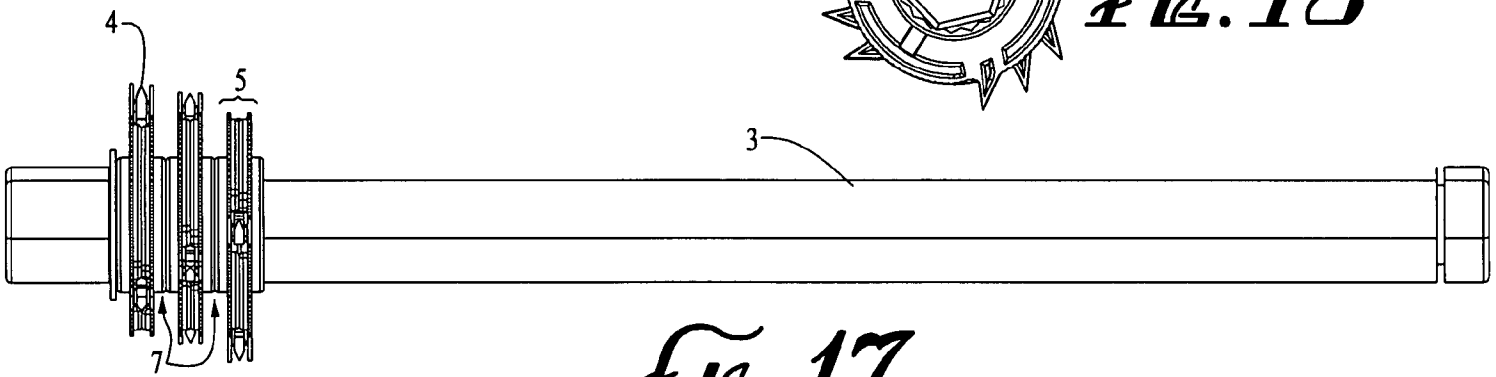
FIG. 17 is a front elevation view of a partially assembled rotary cutting assembly.

FIGS. 16-18 show a partially assembled rotary cutting assembly 1 with the cutting blade assemblies 5 spaced apart. The cutting blade assemblies in this preferred embodiment are spaced apart by the hubs 7 in outer cutting blades 6. The teeth 4 are displaced in the longitudinal direction to form a helix. If the teeth were aligned, then a greater force would be required to punch through paper. By displacing the teeth, a lesser, constant force is required. Though a helix is described herein, any configuration may be used such that the teeth are not aligned. In addition, it may be possible to have varying numbers of teeth around the circumference of each cutting assembly, such that some cutting assemblies have two sets of teeth around its periphery and others have three sets or more.

Figure 19:
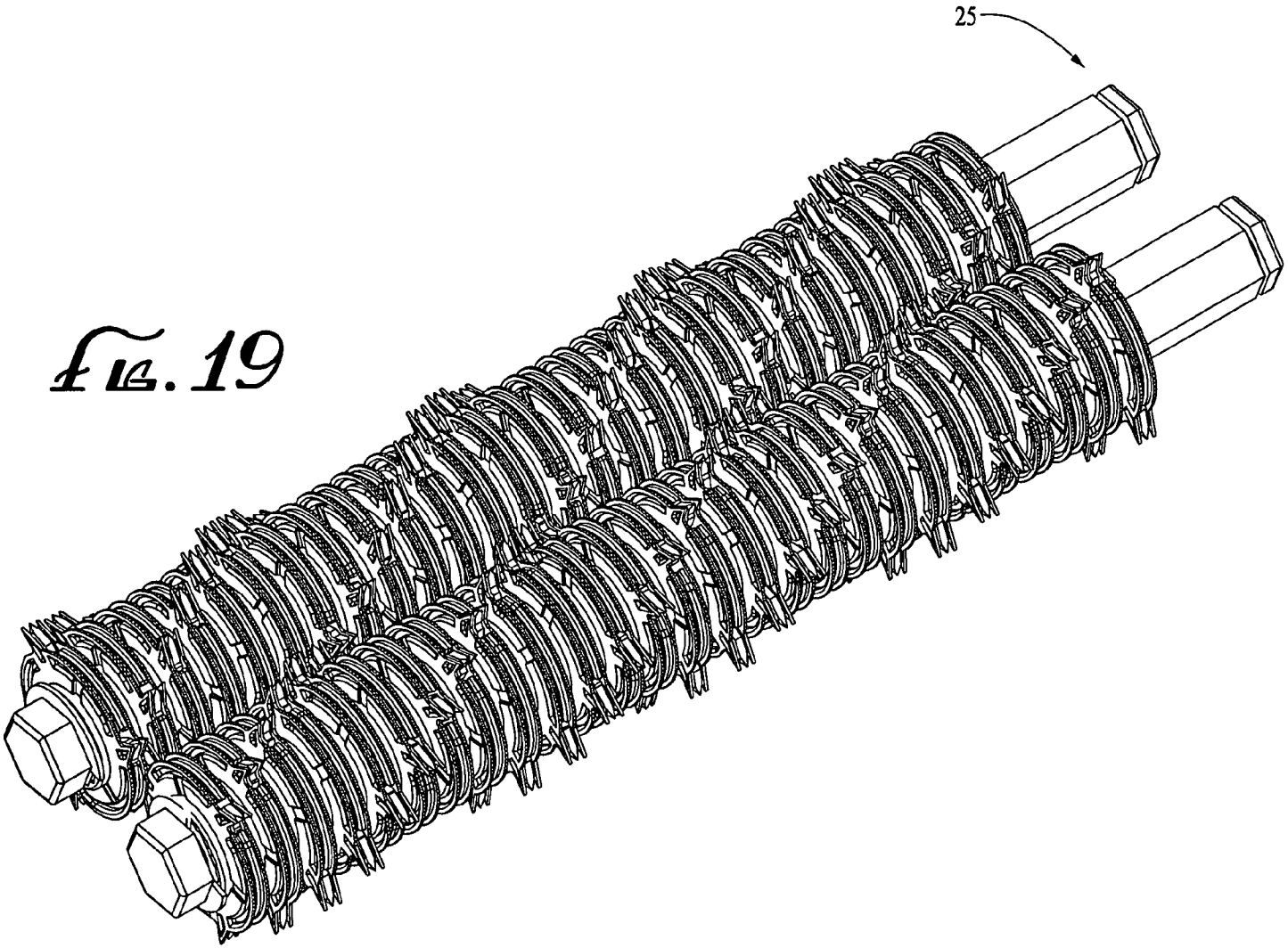
FIG. 19 is a perspective view of two rotary cutting assemblies.
Figure 20:
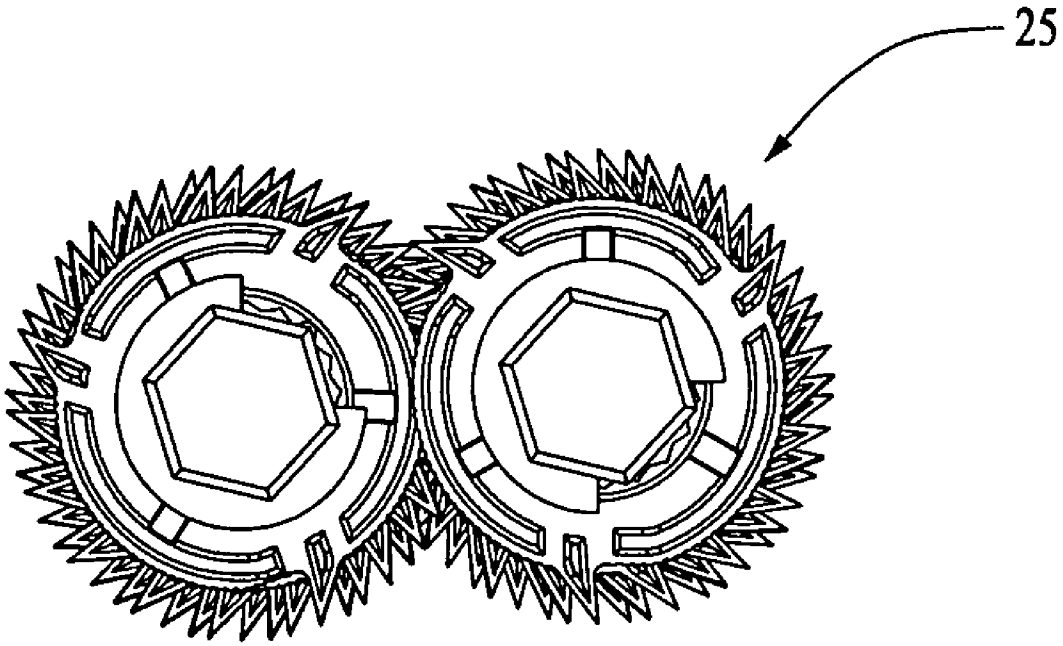
FIG. 20 is a side elevation view of two rotary cutting assemblies.
Figure 21:
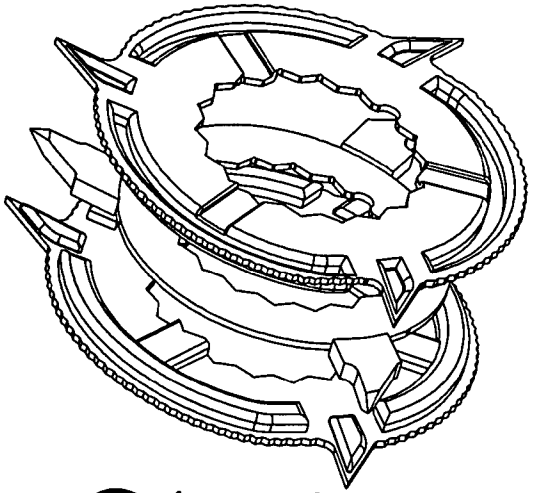
FIG. 21 is a perspective view of three cutting blades embodying features of this invention.
Figure 22:
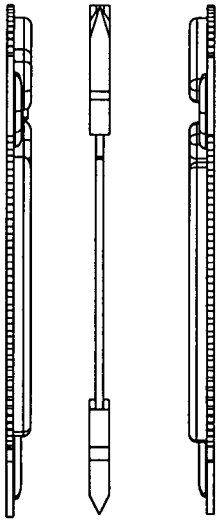
FIG. 22 is a side elevation view of three cutting blades embodying features of this invention.
Figure 23:
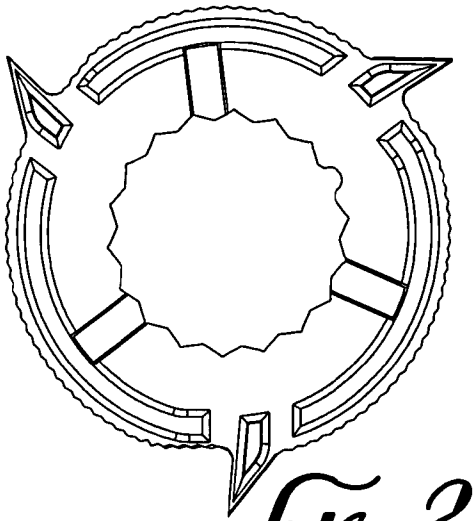
FIG. 23 is a front elevation view of a cutting blade embodying features of this invention.
Figure 24:
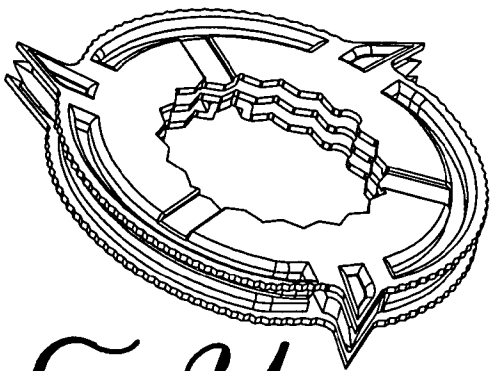
FIG. 24 is a perspective view of three cutting blades embodying features of this invention.
Figure 25:
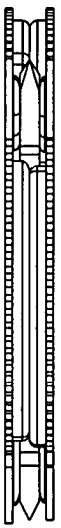
FIG. 25 is a side elevation view of three cutting blades embodying features of this invention.
Figure 26:
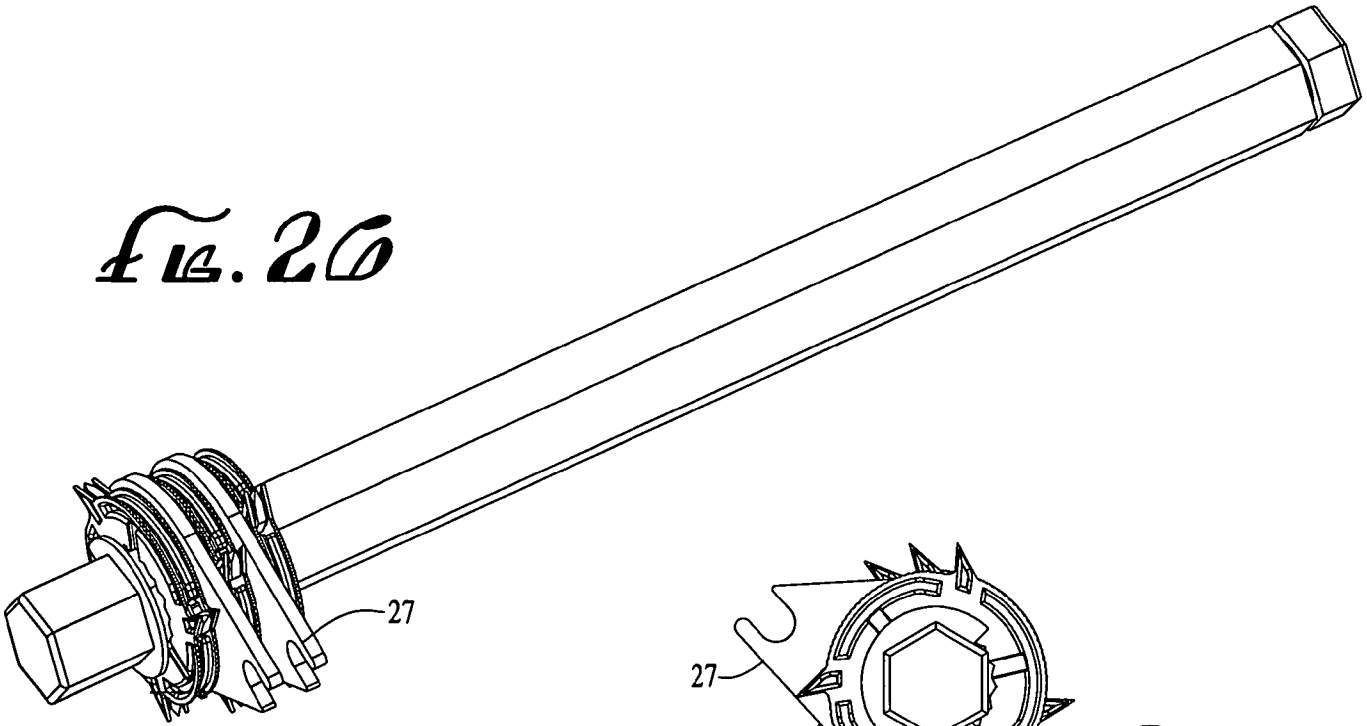
FIG. 26 is a perspective view of a partially assembled rotary cutting assembly with paper strippers.
Figure 28:
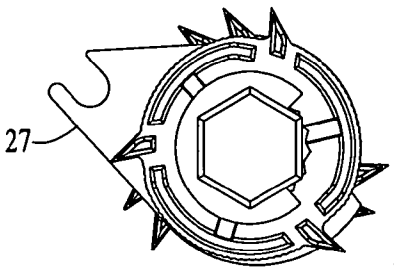
FIG. 28 is a side elevation view of a partially assembled rotary cutting assembly with paper strippers.
Figure 27:
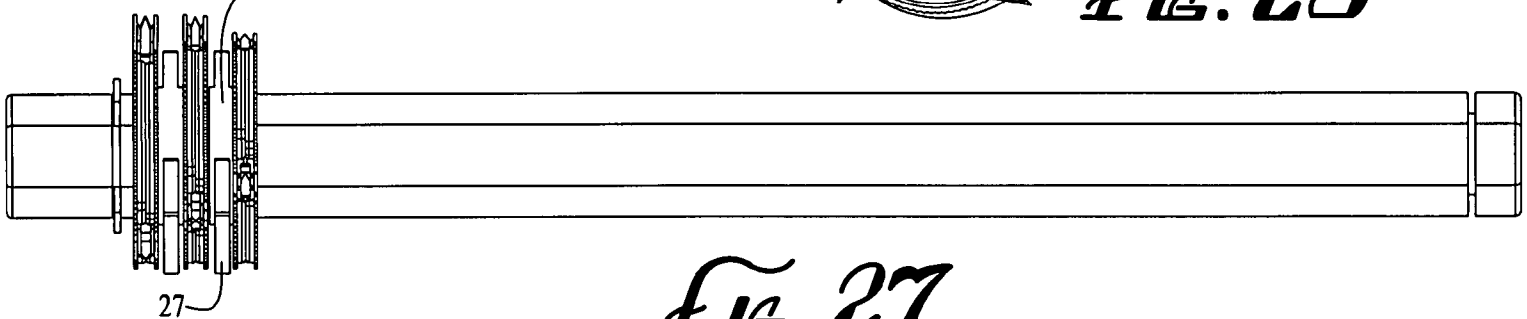
FIG. 27 is a front elevation view of a partially assembled rotary cutting assembly with paper strippers.

FIGS. 19 and 20 show the interaction between two rotary cutting assemblies 25. As paper is fed between the two assemblies, it is shredded into rectangles. The width of the rectangle is determined by the space between the cutting blade assemblies created by the hubs. The length of the rectangle is determined by the distance between the teeth around the circumference of the cutting blade. Though the size can vary, an exemplar shredded piece of paper is 4 mm by 40 mm.

Figure 29:
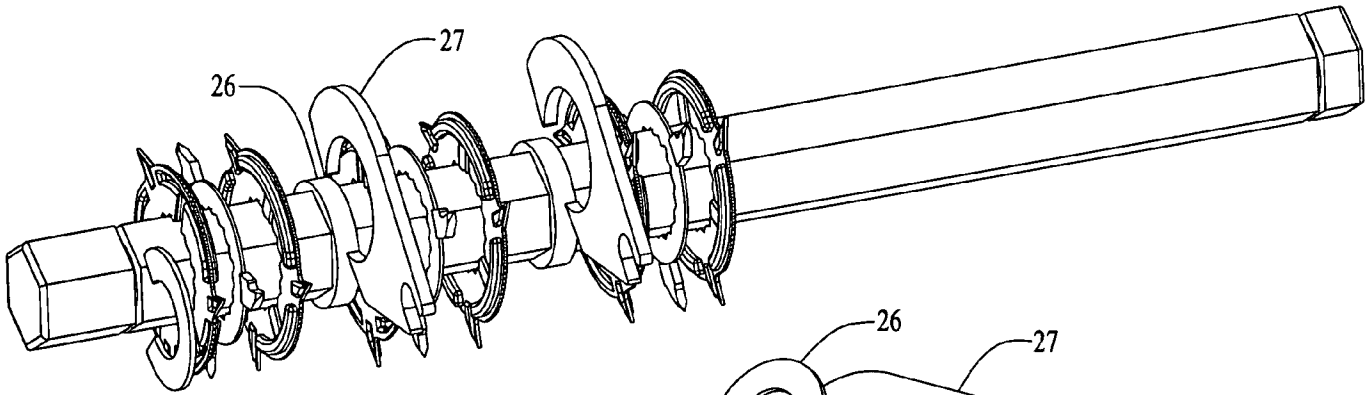
FIG. 29 is a perspective view of a partially assembled rotary cutting assembly with paper strippers.
Figure 30:
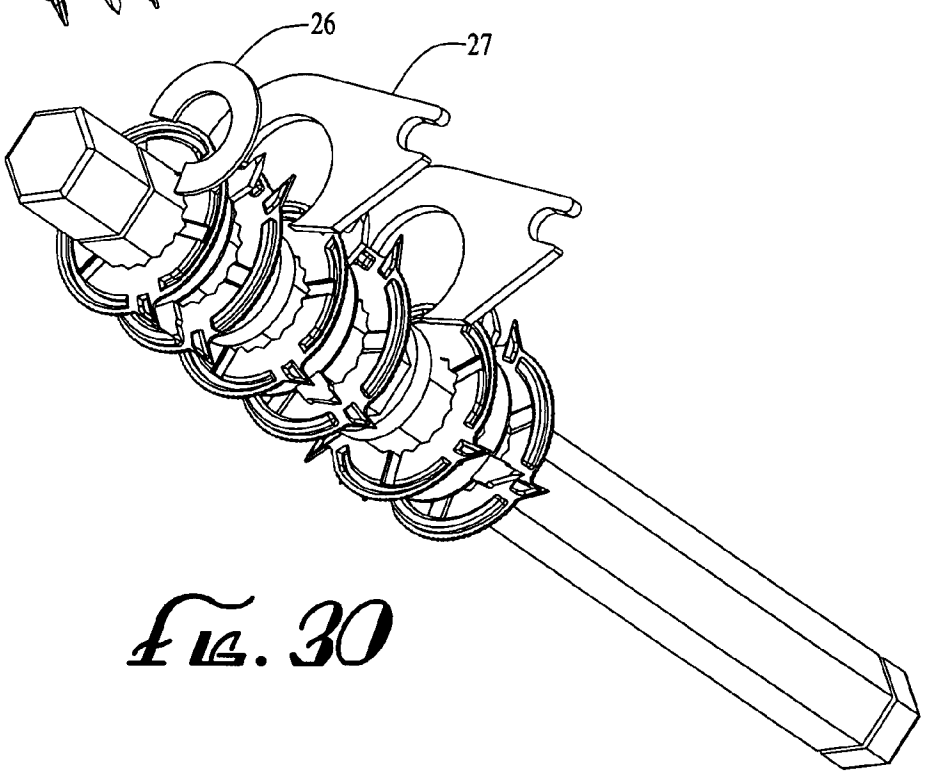
FIG. 30 is a perspective view of a partially assembled rotary cutting assembly with paper strippers.
Figure 31:
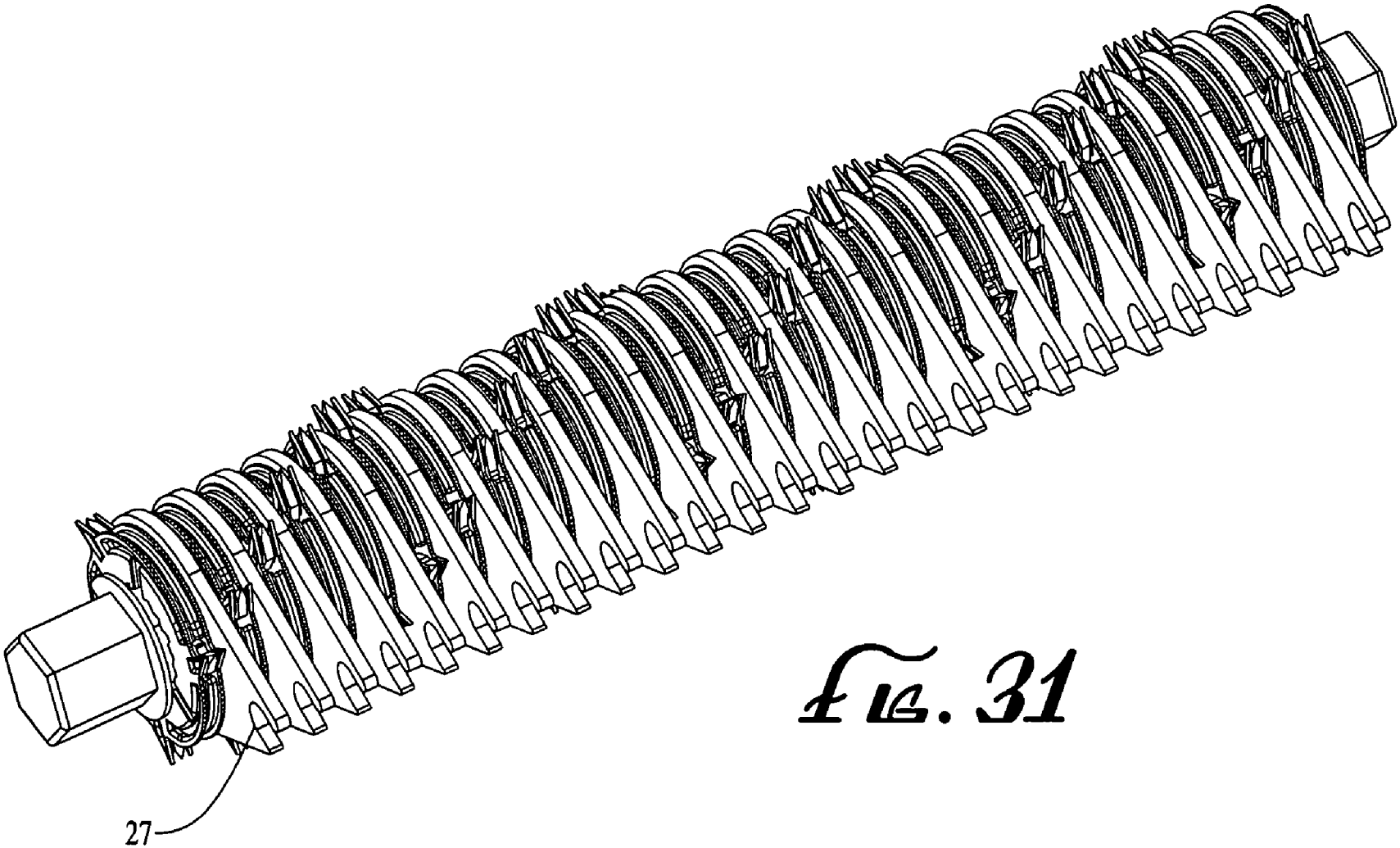
FIG. 31 is a perspective view of a rotary cutting assembly with paper strippers.
Figure 32:
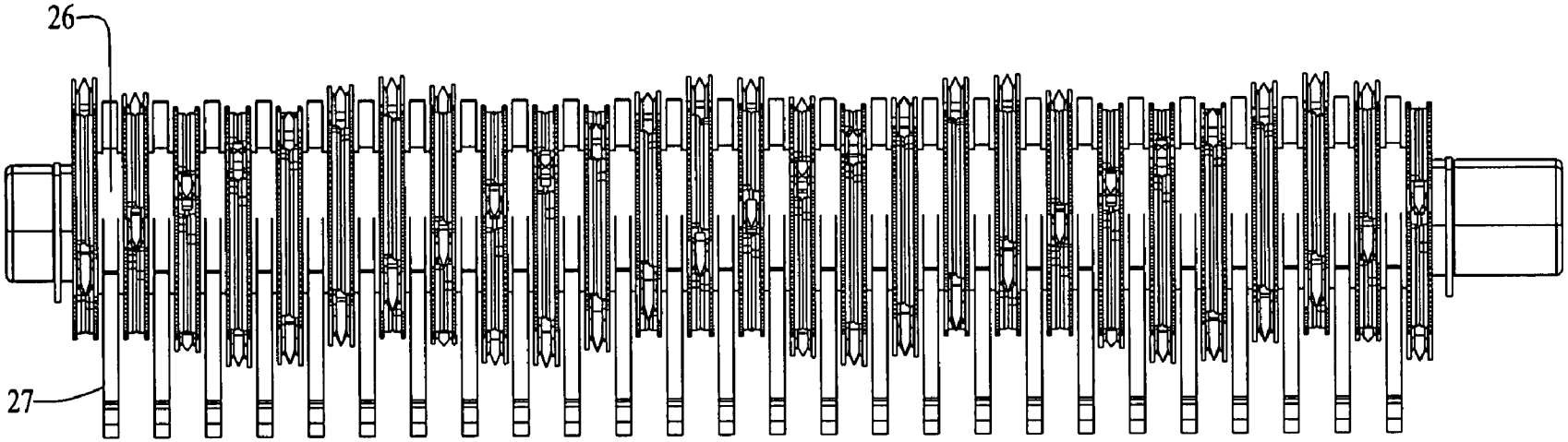
FIG. 32 is a front elevation view of a rotary cutting assembly with paper strippers.
Figure 33:
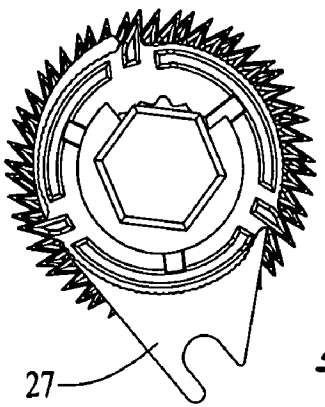
FIG. 33 is a side elevation view of a rotary cutting assembly with paper strippers.

FIGS. 21-25 disclose another preferred embodiment of the present invention. In this embodiment the components are essentially the same as above, except that the cutting blade assembly does not have a hub protruding from it. Since there is no hub to create space between the cutting blade assemblies, a separate spacer 26 is needed to separate the cutting blade assemblies. (See FIGS. 29 & 30.)

As seen in FIGS. 26-33, this preferred embodiment also discloses paper strippers 27 which are coupled to the spacer 26. Both the paper strippers 27 and the spacer 26 are commonly known to those skilled in the art. The paper strippers facilitate the papers shreds to fall downward into the shredder base, and also prevent the paper from accumulating between the cutting blade assemblies. Though the paper strippers were not shown in the previous embodiment, a fully assembled shredder utilizing the rotary cutting assembly above would preferably have the paper strippers coupled to the hubs between the cutting blade assemblies.

Other preferred embodiments are also possible. For example, the principle of three or more adjacent teeth can also be applied to Diamond Cut shredders.

Although the present invention has been described in detail with respect to certain preferred versions thereof, other versions are possible. Therefore, the scope of the claims should not be limited to the description of the preferred versions contained herein.

The invention claimed is:

1. A rotary cutting assembly for a paper shredder comprising:

a plurality of cutting blade assemblies, each cutting blade assembly spaced apart by a spacer along the length of the rotary cutting assembly, at least one of the cutting blade assemblies comprising:

two outer cutting blades each having at least two teeth disposed about the periphery of said outer cutting blades, each tooth reinforced by an indented portion; and an inner cutting blade sandwiched between the outer cutting blades having at least two teeth disposed about the periphery of said inner cutting blade, wherein the inner cutting blade has the same number of teeth as the outer cutting blades and the teeth of the inner and outer cutting blades are aligned.

2. The rotary cutting assembly of claim 1, wherein the teeth of the outer cutting blades are narrower than the teeth of the inner cutting blade.

3. A rotary cutting assembly for a paper shredder comprising:

a plurality of cutting blades, each cutting blade spaced apart by a spacer along the length of the rotary cutting assembly, at least one of the cutting blades having at least two sets of teeth disposed about its periphery, each set of teeth comprising:

two outer teeth with each outer tooth reinforced by an indented portion; and an inner tooth sandwiched between the outer teeth such that the outer teeth and inner teeth are aligned.

4. The rotary cutting assembly of claim 3 wherein each set of teeth is comprised of an inner wider tooth flanked by narrower outer teeth.

* * * * *